US006217945B1

(12) United States Patent
Fowler

(10) Patent No.: US 6,217,945 B1
(45) Date of Patent: Apr. 17, 2001

(54) PROCESS FOR MAKING MULTILAYER COATINGS WITH A STRIPPABLE TOPCOAT

(75) Inventor: Michael Fowler, Nuneaton (GB)

(73) Assignee: PRC-DeSoto International, Inc., Glendale, CA (US)

( * ) Notice: Subject to any disclaimer, the term of this patent is extended or adjusted under 35 U.S.C. 154(b) by 0 days.

(21) Appl. No.: 09/269,094

(22) PCT Filed: Sep. 24, 1997

(86) PCT No.: PCT/GB97/02596

§ 371 Date: Mar. 18, 1999

§ 102(e) Date: Mar. 18, 1999

(87) PCT Pub. No.: WO98/13148

PCT Pub. Date: Apr. 2, 1998

(30) Foreign Application Priority Data

Sep. 26, 1996 (GB) ..... 9620246

(51) Int. Cl.[7] ..... B05D 1/38; B05D 1/02

(52) U.S. Cl. ..... 427/410; 427/409; 427/333; 427/336; 427/142; 427/156

(58) Field of Search ..... 427/142, 156, 427/333, 336, 409, 410, 307

(56) References Cited

U.S. PATENT DOCUMENTS

| | | | | |
|---|---|---|---|---|
| 4,250,219 | | 2/1981 | Pogoda | 428/212 |
| 4,274,887 | | 6/1981 | Pogoda | 148/31.5 |
| 4,590,097 | * | 5/1986 | Booth et al. | 427/154 |
| 5,064,475 | | 11/1991 | Bernasconi | 134/4 |
| 5,922,467 | * | 7/1999 | St. Clair | 428/418 |

FOREIGN PATENT DOCUMENTS

| | | | | |
|---|---|---|---|---|
| 25 28 943 | | 12/1976 | (DE) . | |
| 0 014 597 | | 8/1980 | (EP) . | |
| 0 014 597A1 | * | 8/1980 | (EP) | B05D/5/00 |
| 0 147 984 | | 7/1985 | (EP) . | |
| 2 309 616 | | 11/1976 | (FR) . | |
| 1 511 935 | | 5/1978 | (GB) . | |

OTHER PUBLICATIONS

Hawley, Gessner, The Condensed Chemical Dictionary, 10th edition, New York, p. 462. (No Date), 1981.*

Mish, Frederick, editor, Merriam–Webster's Collegiate Dictionary, 10th edition, Springfield, MA, pp. 435 and 753. (No Date), 1998.*

* cited by examiner

*Primary Examiner*—Shrive Beck
*Assistant Examiner*—Jennifer Kolb
(74) *Attorney, Agent, or Firm*—Ann Marie Cannoni

(57) ABSTRACT

In a process for overcoating a substrate having a cured primer coating with a curable topcoat which when cured is swellable by a stripping solvent, a non-volatile polar material is applied to the primed substrate from an aqueous liquid vehicle before coating with the topcoat. The polar material facilitates the removal of the topcoat from the primer by the stripping solvent, as is required for example when repainting aircraft. The polar material has sufficiently high affinity for the primer surface that it is not washed off the primer surface by water rinsing or by application of the topcoat paint.

30 Claims, No Drawings

PROCESS FOR MAKING MULTILAYER COATINGS WITH A STRIPPABLE TOPCOAT

FIELD OF THE INVENTION

This invention relates to the application to a substrate of a coating system in which a cured primer coating is overcoated with a top coat which is intended to be strippable, that is to say removable from the primed substrate by a stripping solvent without removal of the primer from the substrate. Such coating systems are widely used on aircraft and may also be used on other substrates, for example commercial vehicles, cars, yachts or railway vehicles.

Aircraft are usually painted with a primer which is based on an epoxy resin and a curing agent, particularly an amino-functional curing agent, although the primer can be an alternative cured coating, for example polyurethane. The top coat is usually based on polyurethane, particularly a polyester-urethane. The coatings must resist water and certain organic solvents such as aviation fuel and preferably also resist hydraulic fluids based on phosphate esters such as tricresyl phosphate or tri-n-butyl phosphate, e.g. that sold under the trade mark "Skydrol". Each coating is generally cured by the reaction of components which have been packaged separately and are mixed at or shortly before application. When an aircraft is to be repainted it is usual to remove at least the top coat using a paint stripper before repainting. The preferred stripping solvents used nowadays are based on aqueous benzyl alcohol with acidic (formic acid) or alkaline additives although some halogenated solvents such as methylene chloride with phenol are still used. In general, the top coat adheres to the primer so strongly that the top coat cannot be stripped without removing or at least damaging the primer. Aircraft owners and operators would prefer a paint system in which the primer remained on the aircraft to prevent the stripping solvent contacting any resins, sealants or adhesives used in the aircraft construction or the metallic substrate and to avoid repeating the pretreatment and primer coating of the aircraft.

BACKGROUND ART

Existing strippable coating systems generally use an intermediate coating between the primer and the top coat. One type of intermediate coating, described in GB-A-1511935, is a non-crosslinked polyamide. This at least partially resists the solvent used to remove the top coat and can itself easily be removed by alcohol-based solvents to reveal the primer. Similarly, DE-A-2528943 describes a linear non-crosslinked elastic polyurethane coating used between crosslinked polyurethane primer and top coat layers. EP-A-147984 describes a barrier intermediate coating comprising a film-forming addition polymer comprising units of a vinyl aromatic monomer and units of a monomer containing a hydroxy alkyl group in an amount to provide a hydroxyl content of the addition polymer in the range 0.5 to 5 per cent by weight reacted with a polyisocyanate containing at least 2 isocyanate groups per molecule.

All these prior art intermediate coatings are based on solutions of synthetic resins in organic solvents. There has been a demand for an intermediate coating which releases less, preferably no, volatile organic solvent.

DISCLOSURE OF THE INVENTION

In a process according to the invention for overcoating a substrate having a cured primer coating with a curable top coat which when cured is swellable by a stripping solvent, a non-volatile polar material is applied to the primed substrate from an aqueous liquid vehicle before coating with the top coat, the said polar material having sufficiently high affinity for the primer surface that it is not washed off the primer surface by water rinsing or by application of the top coat paint, whereby the said polar material facilitates the removal of the top coat from the primer by the stripping solvent.

The invention also provides a process for overcoating a substrate having a cured primer coating to facilitate the removal by a stripping solvent of a subsequently applied top coat, characterised in that a non-volatile acidic aromatic polar organic compound is applied to the primed substrate from aqueous solution, the said acidic aromatic compound having sufficiently high affinity for the primer surface that it is not washed off the primer surface by water rinsing.

By a cured primer coating we mean a coating which is curable by chemical reaction when applied and which has cured sufficiently to be at least touch dry at the time when the polar organic compound (polar material) is applied. The polar organic compound is thus usually applied at least 2 or 3 hours after the substrate has been primer coated and may be applied at any later time, including several days or more later when the primer is fully cured.

The polar material is not an intermediate coating as known from the prior art and is generally not a film-forming material. It is non-volatile, that is to say it does not evaporate to any significant extent at 20° C. In some instances it is preferably not polymeric, although polymers or oligomers having a plurality of anionic groups can be used and in other instances may be preferred. The polar material, particularly if it is not polymeric, may be applied at such a low thickness that it is present on the primer surface as a molecular monolayer or partial monolayer, for example a monolayer covering 10 to 60 or 80% of the surface area. Unexpectedly, the polar material allows good adhesion between the top coat and the primer on application of the top coat and in service but greatly weakens the interlayer adhesion between the primer and the top coat when the top coat is swollen by stripping solvent. The suitability of a candidate polar material can be readily assessed by applying it to the primed substrate and rinsing with water to see if it is completely removed.

The primer coating is preferably based on an epoxy resin cured with an amino-functional curing agent such as an amino-functional polyamide and/or an araliphatic diamine. A crosslinked polyurethane primer is an alternative. The primer generally contains an anticorrosive pigment such as a chromate, phosphate, phosphonate or molybdate and may contain one or more other pigments and/or fillers. The primer coating can be applied from solution or dispersion in an organic solvent or can be a high solids or solventless composition or may be applied as an aqueous composition.

Many of the polar materials which have been found to be effective, particularly over amine-cured epoxy primers, contain at least one acidic group such as a carboxylic acid group or sulphonic acid or phosphonic acid group present in free acid or salt form. In general, carboxylic acid groups if present are preferably in free acid form whereas sulphonic or phosphonic acid groups if present are preferably fully or partially neutralised e.g. in alkali metal salt form. The polar material is usually a polar organic compound, preferably a polar organic aromatic compound. The acidic group is preferably attached directly to an aromatic ring. Many of the effective compounds additionally contain at least one hydroxy group and/or amino group. The polar material (polar organic compound) preferably has a molecular weight in the range 120 or 150 up to about 1000 or 1500. Many of the effective compounds are known as dyes, although one of the most preferred compounds is gallic acid (3,4,5-trihydroxy-benzoic acid), which is not generally regarded as a dye. 2,5-Dihydroxybenzoic acid is also effective, although 3,5-dihydroxybenzoic acid is much less effective in giving stripping. 4,5-Dihydroxy-1,3-benzenedisulphonic acid (generally used in disodium salt form) is also effective in giving selective stripping. Examples of acidic dyes which have been found effective in giving selective stripping are Catechol Violet, Fast Green, Lissamine Green SF, Orange G, Amido Black and Methyl Orange. The chemical structures of these dyes are shown below.

Amido Black

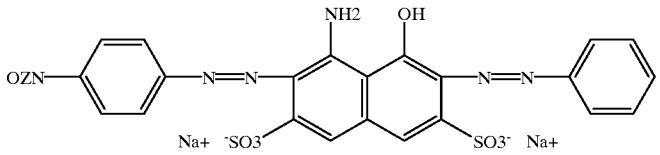

Fast Green

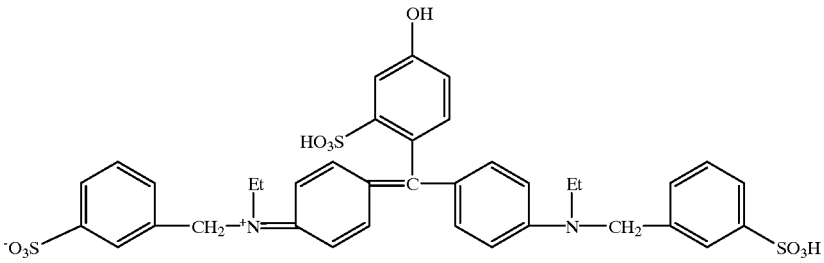

Lissamine Green SF

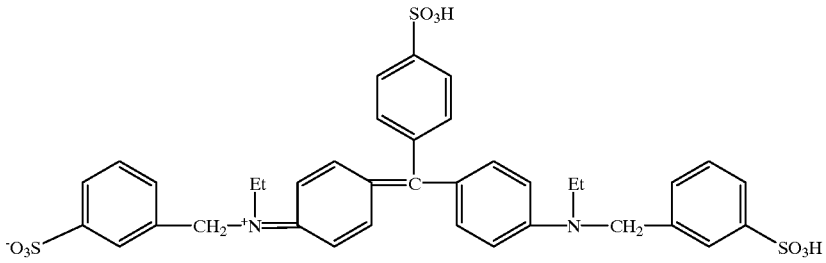

Orange G

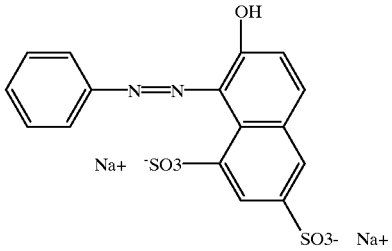

Catechol Violet

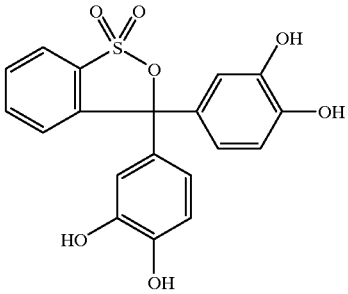

-continued

Methyl Orange

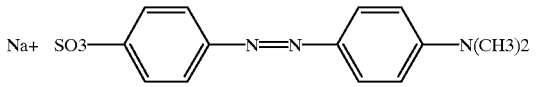

Mixtures of polar materials can be used, for example mixtures of gallic acid with a dye such as Past Green. Further examples of acidic dyes which can give selective stripping are sulphonyl porphyrins, for example 5, 10, 15, 20-tetrakis (4-sulphonatophenyl)-porphine manganese (III) chloride of molecular weight 1023, bromocresol purple, calcion (a sulphonate-functional dye), fluorescent brightener 28 (an optical brightener), Nigrosin (Acid Black 2), Brilliant Black BN, citrazinic acid, xylenol blue Na salt, Reactive Blue 2, xylenol orange Na salt, Brilliant Blue R, Brilliant Blue G and chromoxane cyanine R. Aurin (rosolic acid), which is an acid dye although it does not contain any carboxylic or stronger acid groups, is also moderately effective.

The dye Safranine O, having the structure

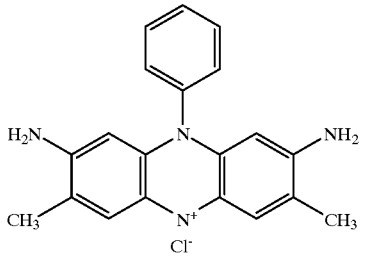

which does not contain any acidic groups, has also been found to be effective, although other dyes containing amine or hydroxyl groups with no acidic groups such as malachite green, night blue and crystal violet have been found to be ineffective.

Examples of acid-functional polymeric polar materials which have given selective stripping are a hyperbranched poly (5-hydroxyisophthalic acid), poly(styrene sulphonate) in sodium salt form, sodium polyphosphate and polyacrylic acid. Guluronic acid oligomer and mannuronic acid oligomer (obtained by depolymerisation of alginic acid) are also effective. All of these materials can be applied from aqueous solution.

Gluconic acid is an example of a non-aromatic acidic organic polar compound which is quite effective in giving selective stripping. We have found that materials sold as surfactants are usually ineffective in giving selective stripping.

The concentration of polar material in the liquid aqueous vehicle applied to the primed substrate is generally in the range 0.0001 to 20 g/L (grams per liter). The polar material is preferably applied from aqueous solution. The aqueous composition is preferably coated on the primed substrate and then rinsed with water, although it may be simply coated on the primed substrate without rinsing. The aqueous liquid vehicle may contain an organic solvent (preferably of low volatility) to improve wetting of the primer surface, for example a terpene (which may be used with a surfactant) or N-methyl pyrrolidone. If such an organic solvent is used it is preferably present at less than 20%, most preferably less than 10%, by weight of the aqueous liquid vehicle. If rinsing is to be used, the aqueous solution of the polar material generally has a concentration of at least 0.01 g/L and preferably at least 0.1 g/L of the polar material, and the solution is preferably thickened, for example so that it is thixotropic or pseudoplastic or has a viscosity similar to that of conventional paints. The thickening agent used can for example be a fine-particle silica gel such as that sold under the Trade Mark "Aerosil 200", which can for example be used at 1 to 4% by weight of the aqueous composition, and/or a bentonite clay and/or a polysaccharide. The concentration of polar material in such a thickened solution is generally up to 10 or 20 g/L, for example 0.2 to 5 g/L. The aqueous composition can be applied by conventional coating methods such as spray, for example airless spray, roller or brush, and it is preferably left in contact with the primed surface for at least 1 or 2 minutes up to 1 or 3 hours or even 24 hours before rinsing with water. We have found that even after thorough rinsing a thin layer of the polar material, generally $10^{-5}$ to $10^{-3}$ grams per square meter, remains firmly bound to the primer. We believe that, particularly at the lower end of the range, this amount of polar material corresponds to a monolayer or partial monolayer (a monolayer covering a substantial part of the primed surface).

If rinsing is not to be used, the aqueous solution of polar material is preferably applied to the primed substrate as a fine spray, for example an aerosol spray, to ensure even distribution of the polar material. The concentration of polar material in the aqueous solution is preferably 0.0001 to 2 g/L, particularly 0.001 to 0.01 or 0.1 g/L, for aerosol spray, although higher concentrations can be used if the aerosol spray is fine enough to give even distribution. The amount of polar material applied is preferably $10^{-5}$ to $10^{-1}$, most preferably $10^{-4}$ to $10^{-3}$ or $10^{-2}$, grams per square meter if rinsing is not to be used. This amount of polar material, particularly at the higher end of the range, gives rise to a coating which is thicker than a monolayer and may be up to 50 molecular layers, for example 5 to 25 molecular layers, thick. We have found that for gallic acid a partial monolayer generally gives the best results whereas for some dye molecules a coating thicker than a monolayer gives the best results. Even when rinsing is not used, the polar material should have sufficient affinity for the primer surface that it is not washed off the primer surface by water rinsing.

The top coat paint applied is generally a curable coating comprising two or three co-reactive components which are usually packaged separately and mixed at application (for example by twin-feed spray) or shortly before application (for example up to 8 hours before). The top coat paint, particularly for aircraft coatings, is preferably a polyurethane such as a polyester-urethane, although other curable paints such as polyester, fluoropolymer or acrylic polymer paints, based for example on oxazolidine-functional acrylic polymers, can be used. The top coat paint is preferably applied from organic solvent solution, but it can in general be applied from dispersion in water and/or organic solvent.

Whether or not rinsing has been used, the solution of polar material is preferably allowed to dry on the primed substrate for at least 30 minutes, preferably at least 2 or 3 hours, before the top coat is applied.

After the top coat has been allowed to cure, preferably for at least 3 days, it adheres firmly to the primer, and the coating system is resistant to spraying with salt-laden water and to immersion in "Skydrol" phosphate ester and generally to immersion in water without separation of the top coat from the primer or significant blistering. However, when the top coat is treated with a paint stripper in which it swells, particularly a stripper of a type used commercially to strip aircraft paints, swelling of the top coat is followed by detachment from the primer. The top coat lifts off the primer and may fall right away or is readily removed by low-pressure water washing. The top coat can readily be removed within a time which is generally 10 minutes to 5 hours and usually 0.5 to 2 hours after application of the paint stripper, without any removal of the primer. The primer may be somewhat swollen or discoloured by the paint stripper, but it resists removal with the top coat and continues to adhere to the substrate. Any swelling of the primer subsides as the paint stripper dries. The stripper most widely used to strip aircraft paints, particularly polyurethane top coats, is an aqueous thickened mixture of benzyl alcohol and formic acid. Alternative strippers are alkaline thickened aqueous benzyl alcohol or a stripper based on methylene chloride and phenol (used to strip certain fluoropolymer and acrylic top coats).

We are not clear exactly what happens to the polar material bound to the primer surface when the paint stripper is applied. It is strongly preferred that the polar material should be re-applied to the primer surface before a fresh layer of top coat is applied so that the fresh top coat is strippable.

The invention is illustrated by the following Examples.

EXAMPLE 1

Aluminium panels were coated with a 20 micron layer of an epoxy primer based on a condensed bisphenol A/epichlorhydrin epoxy resin and an amine curing agent containing anticorrosive pigments applied from organic solvent solution and allowed to cure at ambient temperature.

5 hours after application of the primer, the primed panels were sprayed with a 0.9 g/L aqueous solution of gallic acid. After 10 minutes the panels were rinsed with tap water and left to dry overnight. A partial monolayer of gallic acid adhered to the primer surface. Spectroscopic surface analysis indicated that the gallic acid monolayer covered about 15% of the surface and that the amount of gallic acid on the surface was about $3\times10^{-5}$ g/m$^2$ of surface.

24 hours after the rinse step, the panels were spray-coated with a pigmented polyurethane top coat paint at 60 microns dry film thickness applied from organic solvent blend. The top coat was a 2-pack polyurethane of a type commonly used for aircraft, comprising a hydroxy-functional polyester component and an aliphatic polyisocyanate component. The top coat was allowed to cure under ambient conditions for two weeks before being tested for strippability and chemical resistance.

Some of the coated panels were coated with "Turco 9090" benzyl alcohol-based stripping solvent. After 90 minutes the top coat layer had lifted off the primer.

The top coat was then readily removed by the low-pressure water wash used to clean off the stripping solvent (some fell off even before washing), leaving a clean intact primer surface.

Some of the coated panels were coated with "Turco 6776" formic acid-based stripping solvent. After 1 hour the top coat layer had lifted off the primer and was readily removed.

Some of the coated panels were tested by immersion in hot (70° C.) "Skydrol" hydraulic fluid for 17 days. No deterioration was observed.

Some of the coated panels were tested by immersion in cold tap water for 15 days. Very slight blistering was observed but the adhesion of the coating was 100% in a cross-hatch adhesion test whether carried out wet or after drying.

EXAMPLES 2 TO 4

The process of Example 1 was repeated using a 0.66 g/L solution of Fast Green dye in place of gallic acid. Spectroscopic surface analysis indicated that the dye monolayer covered about 35% of the surface and that there was about $1\times10^{-4}$ g/m$^2$ of the dye on the surface. Example 1 was also repeated for both chemicals applied 19 hours (rather than 5 hours) after primer application. In all cases satisfactory stripping of the top coat was achieved (time required for clean strips may vary). The results are summarised in the following Table 1.

TABLE 1

| Example No | Chemical used | Time applied (after primer) | Stripping in "Turco 9090" | stripping in "Turco 6776" | Skydrol resistance (17 days at 70° C.) | Water resistance (15 days at 20° C.) | Salt spray test results |
|---|---|---|---|---|---|---|---|
| 1 | Gallic acid | 5 hours | Clean strip after 90 minutes | clean strip after 75 minutes | No deterioration | No significant blistering. 100% adhesion wet and dry | No undercoat corrosion. Very slight lifting at scribe |
| 2 | Fast Green | 5 hours | Clean strip after 1 hour | clean strip after 1 hour with discoloration of primer | Generally good, but slight loss of top coat at edge of panel | Blistering and loss of wet adhesion (Adhesion good after drying) | No undercoat corrosion. Very slight lifting at scribe |
| 3 | Gallic acid | 19 hours | Clean strip after 90 minutes | clean strip after 75 minutes with discoloration of primer | Swelling at edge of panel | No significant blistering. 100% adhesion wet and dry | No undercoat corrosion. Very slight intercoat delamination at scribe |

TABLE 1-continued

| Example No | Chemical used | Time applied (after primer) | Stripping in "Turco 9090" | stripping in "Turco 6776" | Skydrol resistance (17 days at 70° C.) | Water resistance (15 days at 20° C.) | Salt spray test results |
|---|---|---|---|---|---|---|---|
| 4 | Fast Green | 19 hours | Clean strip after 1 hour | Clean strip after 75 minutes with slight discoloration of primer | No deterioration | Slight blistering. Adhesion 20% wet, 100% dry | No undercoat corrosion, no defects |

The coating systems of Examples 1 and 2 were also tested for strippability using "Turco 1270/5" stripping solvent, which is an alkaline aqueous benzyl alcohol-based solvent. The coating system of Example 2 gave a clean strip (clean lifting off the top coat) after 90 minutes. The coating system of Example 1 required 4.5 hours in contact with the stripping solvent, but a clean strip of the top coat was then achieved.

EXAMPLES 5 TO 8

Following the procedure of Example 1, panels were coated with coating systems in which the following polar organic compounds were used in place of gallic acid.

| | Polar organic compound | Concentratio in aqueous solution |
|---|---|---|
| Example 5 | Catechol Violet | 0.64 g/L |
| Example 6 | Nigrosin | 0.8 g/L |
| Example 7 | Lissamine Green SF | 1.3 g/L |
| Example 8 | 2,5-dihydroxybenzoic acid | 6.2 g/L |

The strippability test used was a quick test using formic acid. Very good strippability (top coat detached itself) was achieved in 10 minutes in Examples 5 and 6, and the top coat could be easily stripped off in Example 7 and fairly easily in Example 8.

EXAMPLES 9 TO 17

Aluminium panels were chromic acid pickled prior to coating. The primer specified in Table 2 below was spray applied and dried for 4 hours at 50% relative humidity (R.H.) and 22° C. The primed panels were dipped in a 0.2% by weight solution of aqueous gallic acid for 20 minutes, then rinsed with tap water and air dried at 50% R.H. and 22° C. for 24 hours before topcoating with the top coat specified in Table 2. Stripping tests were carried out in duplicate, after 7 days' drying, on the fully coated panels at 50% R.H. and 22° C. The strippers used were "Turco 9090" (formic/oxalic acid based) for Examples 9–14 and "Turco 5351" (methylene chloride/phenol based) for Examples 15–17. Two further dried panels were tested for Skydrol and water resistance (2 weeks' Skydrol immersion at 70° C. and 7 days' water immersion at 40° C.; respectively).

TABLE 2

| Example | Primer | Top Coat |
|---|---|---|
| 9 | Epoxy-amine of Example 1 | Ti-Flex* Polyester-urethane of Example 1 |

TABLE 2-continued

| Example | Primer | Top Coat |
|---|---|---|
| 10 | Epoxy-amine of Example 1 | Desothane HS* high-solids polyurethane (volatile organic content 420 g/L) |
| 11 | DesoPrime* high-solids epoxy-amine (volatile organic content 360 g/L) | Polyester-urethane of Example 1 |
| 12 | High solids epoxy-amine | Desothane HS |
| 13 | Crosslinked polyester urethane | Desothane HS |
| 14 | Chromate-free epoxy-amine primer | Desothane HS |
| 15 | Crosslinked polyurethane | Aviox* acrylic-oxazolidine polymer |
| 16 | 2-pack water-based epoxy-amine | "LLT 2000" Fluoropolymer |
| 17 | 2-pack water-based epoxy amine | Aviox |

*Ti-Flex, Desothane, Desoprime and Aviox are Trade Marks.

All of the Examples showed selective stripping, with the top coat lifting off the primer within 90 minutes and then being readily removed by low-pressure water wash.

Examples 9 to 13 and 15 to 17 showed no deterioration in the Skydrol immersion test. The paint system of Example 14 resisted Skydrol for 5 days but showed some loss of adhesion after 14 days' Skydrol immersion.

All of the Examples survived the water immersion test without blistering or other deterioration.

EXAMPLES 18 TO 40

The polar materials described in Table 3 below showed at least reasonable efficacy in a brief preliminary selective stripping test.

Aluminium panels were coated with an epoxy/amine primer clear coat as in Example 1 and aged for 4 hours at 23° C. before being dipped in a 1 g/L aqueous solution of the polar material at 30–35° C. for 30 minutes. The panels were not rinsed but were stood vertically to air-dry for 135 minutes, and then top-coated with Desothane white polyurethane top coat. The fully coated panel was dried at ambient temperature for about 24 hours and then at 40° C. overnight.

The panels were then tested for selective stripping by "Turco 9090" aqueous benzyl alcohol/formic acid-based stripping solvent and by "Turco 1270/5" stripping solvent which comprises aqueous benzyl alcohol made alkaline to pH12.

The time of contact in minutes with each stripping solvent is shown in Table 3, as is the degree of stripping, that is to say the percentage of the area of the panel over which the top coat was readily stripped from the primer.

| Example No. | Polar Material | Turco 9090 Time of Contact min | Turco 9090 % Selective Stripping | Turco 1270/5 Time of Contact min | Turco 1270/5 % Selective Stripping |
|---|---|---|---|---|---|
| 18 | Sulphonyl porphyrin | 26 | 100 | 26 | 95 |
| 19 | Hyperbranched polyester of 5-hydroxy-isophthalic acid | 20 | 95 | 30 | 100 |
| 20 | Bromocresol purple | 27 | 90 | 27 | 97.5 |
| 21 | Calcion | 27 | 100 | 27 | 95 |
| 22 | Fast Green-Gallic acid (50/50 by weight mixture) | 29 | 97.5 | 29 | 85 |
| 23 | Poly (styrene sulphonate) Na salt | 25 | 90 | 25 | 100 |
| 24 | Guluronic acid oligomer of Mn 520 | 25 | 90 | 25 | 100 |
| 25 | Mannuronic acid oligomer of Mn 2250 | 25 | 75 | 25 | 92.5 |
| 26 | Fluorescent Brightener 28 | 27 | 90 | 57 | 92 |
| 27 | Brilliant Black BN | 23 | 82.5 | 25 | 90 |
| 28 | Sodium polyphosphate | 25 | 75 | 44 | 95 |
| 29 | 4,5-dihydroxy-1,3-benzene disulphonic acid, Na salt | 35 | 80 | 48 | 85 |
| 30 | Purpurogallin | 25 | 60 | 25 | 100 |
| 31 | Citrazinic acid | 27 | 80 | 28 | 75 |
| 32 | Xylenol blue Na salt | 44 | 65 | 44 | 90 |
| 33 | Reactive Blue 2 | 29 | 60 | 60 | 95 |
| 34 | Rosolic acid Na salt | 25 | 90 | 116 | 60 |
| 35 | Xylenol orange Na salt | 26 | 70 | 80 | 80 |
| 36 | Brilliant blue R | 22 | 65 | 30 | 77.5 |
| 37 | Brilliant blue G | 25 | 80 | 56 | 60 |
| 38 | Poly (acrylic acid) | 25 | 95 | 48 | 45 |
| 39 | Gluconic acid | 40 | 60 | 40 | 80 |
| 40 | Chromoxane cyanine R | 27 | 60 | 40 | 80 |
| | none | 25 | 0 | 66 | 0 |

As can be seen from the Table, all these materials gave selective stripping over at least 70% of the area of the panel (average over two strippers) in these tests. Without the polar material, no selective stripping was achieved. Use of conventional surfactants such as sodium stearate in place of the above polar materials also gave no selective stripping.

What is claimed is:

1. A process for overcoating a substrate having a cured primer coating with a curable top coat which when cured is swellable by a stripping solvent, comprising:

applying a non-volatile, non-film-forming, polar material to the primed substrate from an aqueous liquid vehicle; and applying a top coat over the polar material, the said polar material having sufficiently high affinity for the primer surface that it is not washed off the primer surface by water rinsing or by application of the top coat paint, whereby the said polar material facilitates the removal of the top coat from the primer by the stripping solvent.

2. A process according to claim 1, in which the polar material is a polymer or oligomer having a plurality of anionic groups.

3. A process according to claim 1, in which the primer coating is based on an epoxy resin cured with an amino-functional curing agent.

4. A process according to any of claim 1, in which the primer coating is based on a crosslinked polyurethane.

5. A process according to claim 1, in which the primed substrate bearing the polar material is subsequently overcoated with a top coat comprising a curable polyurethane.

6. A process according to claim 1, in which the primed substrate bearing the polar material is subsequently overcoated with a top coat comprising a curable polyester, fluoropolymer or acrylic polymer.

7. A process according to claim 1, in which the polar material is applied from a thickened aqueous solution.

8. A process according to any of claim 1, in which the primed substrate is rinsed with water after application of the polar material.

9. A process according to claim 8, in which the polar material is applied to the primed substrate from an aqueous solution having a concentration of 0.01 to 20 grams per liter.

10. A process according to claim 1, in which the polar material is applied to the primed substrate by aerosol spray.

11. A process according to claim 10, in which the concentration of polar material in the aerosol spray is 0.0001 to 2 grams per liter.

12. A process according to claim 1, in which the polar material when coated is present as a molecular monolayer or partial monolayer on the primed surface.

13. A process for overcoating a substrate having a cured primer coating with a curable top coat which when cured is swellable by a stripping solvent, comprising:

applying a non-volatile polar material to the primed substrate from an aqueous liquid vehicle; and applying a top coat over the polar material, the said polar material having sufficiently high affinity for the primer surface that it is not washed off the primer surface by water rinsing or by application of the top coat paint, whereby the said polar material facilitates the removal of the top coat from the primer by the stripping solvent, in which the polar material is a non-polmeric organic compound having a molecular weight in the range 120 to 1500.

14. A process according to claim 13, in which the polar material is a non-polymeric aromatic organic compound having a molecular weight in the range 150 to 1000.

15. A process for treating a substrate having a cured primer coating to facilitate the removal by a stripping solvent of a subsequently applied top coat, comprising:

applying a non-volatile, non-film-forming, acidic aromatic polar organic compound to the primed substrate from aqueous solution, the said acidic aromatic compound having sufficiently high affinity for the primer surface that it is not washed off the primer surface by water rinsing.

16. A process according to claim 15, in which the aromatic compound contains at least one carboxylic acid group.

17. A process according to claim 15, in which the primer coating is based on an epoxy resin cured with an amino-functional curing agent.

18. A process according to claim 15, in which the primer coating is based on a crosslinked polyurethane.

19. A process according to claim 15, in which the primed substrate bearing the polar material is subsequently overcoated with a top coat comprising a curable polyurethane.

20. A process according to claim 15, in which the primed substrate bearing the polar material is subsequently overcoated with a top coat comprising a curable polyester, fluoropolymer or acrylic polymer.

21. A process according to claim 15, in which the polar material is applied from a thickened aqueous solution.

22. A process according to claim 15, in which the primed substrate is rinsed with water after application of the polar material.

23. A process according to claim 22, in which the polar material is applied to the primed substrate from an aqueous solution having a concentration of 0.01 to 20 grams per liter.

24. A process according to claim 15, in which the polar material is applied to the primed substrate by aerosol spray.

25. A process according to claim 24, in which the concentration of polar material in the aerosol spray is 0.0001 to 2 grams per liter.

26. A process according to claim 15, in which the polar material when coated is present as a molecular monolayer or partial monolayer on the primed surface.

27. A process for treating a substrate having a cured primer coating to facilitate the removal by a stripping solvent of a subsequently applied top coat, comprising:

applying a non-volatile, acidic aromatic polar organic compound to the primed substrate from aqueous solution, the said acidic aromatic compound having sufficiently high affinity for the primer surface that it is not washed off the primer surface by water rinsing, in which the aromatic compound contains at least one sulphonic acid group.

28. A process for treating a substrate having a cured primer coating to facilitate the removal by a stripping solvent of a subsequently applied top coat, comprising:

applying a non-volatile, acidic aromatic polar organic compound to the primed substrate from aqueous solution, the said acidic aromatic compound having sufficiently high affinity for the primer surface that it is not washed off the primer surface by water rinsing, in which process the aromatic compound contains at least one carboxylic acid group and at least one group selected from hydroxy groups and amino groups.

29. A process according to claim 28, in which the aromatic compound is gallic acid.

30. A process for treating a substrate having a cured primer coating to facilitate the removal by a stripping solvent of a subsequently applied top coat, comprising:

applying a non-volatile, acidic aromatic polar organic compound to the primed substrate from aqueous solution, the said acidic aromatic compound having sufficiently high affinity for the primer surface that it is not washed off the primer surface by water rinsing, in which the aromatic compound contains at least one sulphonic acid group, and at least one group selected from hydroxy groups and amino groups.

* * * * *